US008844162B2

(12) United States Patent
Krell et al.

(10) Patent No.: US 8,844,162 B2
(45) Date of Patent: Sep. 30, 2014

(54) DEVICE AND METHOD FOR REMOVING FLUIDS AND/OR SOLIDS

(75) Inventors: Lothar Krell, Erkerode (DE); Gerald Caspers, Meine (DE)

(73) Assignee: BMA Braunschweigische Maschinenbauanstalt AG, Braunschweig (DE)

( * ) Notice: Subject to any disclaimer, the term of this patent is extended or adjusted under 35 U.S.C. 154(b) by 930 days.

(21) Appl. No.: 13/003,976

(22) PCT Filed: Jul. 14, 2009

(86) PCT No.: PCT/EP2009/058977

§ 371 (c)(1),
(2), (4) Date: Mar. 15, 2011

(87) PCT Pub. No.: WO2010/007057

PCT Pub. Date: Jan. 21, 2010

(65) Prior Publication Data

US 2011/0162229 A1 Jul. 7, 2011

(30) Foreign Application Priority Data

Jul. 14, 2008 (EP) ..... 08012666

(51) Int. Cl.
*F26B 17/14* (2006.01)
*F26B 3/08* (2006.01)
*F26B 25/00* (2006.01)

(52) U.S. Cl.
CPC ..... *F26B 3/08* (2013.01); *F26B 25/002* (2013.01)
USPC ..... 34/576; 34/588; 34/589; 34/168

(58) Field of Classification Search
CPC ..... F26B 17/14; F26B 25/002; F26B 25/08; F26B 25/12; F26B 25/14
USPC ..... 34/58, 59, 576, 586, 587, 588, 589, 34/591, 593, 168; 210/175
See application file for complete search history.

(56) References Cited

U.S. PATENT DOCUMENTS

| | | | | |
|---|---|---|---|---|
| 3,360,867 | A | 1/1968 | Sanderson | |
| 4,593,477 | A | 6/1986 | Dziubakowski et al. | |
| 4,832,700 | A | 5/1989 | Kaspar et al. | |
| 5,289,643 | A * | 3/1994 | Jensen | 34/169 |
| 2008/0189980 | A1 | 8/2008 | Krell et al. | |

FOREIGN PATENT DOCUMENTS

| | | | |
|---|---|---|---|
| CH | 652 940 | A5 | 12/1985 |
| DE | 1 932 388 | A1 | 1/1970 |
| DE | 24 21 278 | A1 | 11/1974 |

(Continued)

OTHER PUBLICATIONS

International Search Report mailed Sep. 25, 2009 for International Application No. PCT/EP2009/058977.

*Primary Examiner* — Jiping Lu
(74) *Attorney, Agent, or Firm* — Jones Day

(57) ABSTRACT

A device for removing fluids from particulate materials, including a container having a circular process chamber with a cylindrical external contour, an input device for inputting the materials into the process chamber, a discharge device for discharging the particulate materials freed of the fluid from the process chamber, a feed device for feeding a fluidizing agent from below into the process chamber, and at least one conditioning device for conditioning the fluidization agent in the direction of flow prior to the feed device.

19 Claims, 5 Drawing Sheets

(56) References Cited

FOREIGN PATENT DOCUMENTS

| | | | |
|---|---|---|---|
| EP | 0 183 154 | A2 | 6/1986 |
| EP | 0 955 511 | A2 | 11/1999 |
| EP | 1 044 732 | A1 | 10/2000 |
| EP | 1 956 326 | A1 | 8/2008 |
| FR | 1 260 884 | A | 5/1961 |
| GB | 833 232 | A | 4/1960 |
| GB | 1 449 372 | | 9/1976 |
| JP | 11 142056 | A | 5/1999 |

* cited by examiner

Figure 5a

| | |
|---|---|
| Differenzdruck | Differential pressure |
| Wirbelschicht | Fluidized bed |
| Fluidisierungsmedium | Fluidizing medium |

Figure 5b

| | |
|---|---|
| Wirbelschicht | Fluidized bed |
| Fluidisierungsmedium | Fluidizing medium |

Figure 5c

| | |
|---|---|
| Fluidisierungsmedium | Fluidizing medium |

Figure 6

| | |
|---|---|
| *Stand der Technik* | *Prior art* |

Figure 7

| | |
|---|---|
| *Stand der Technik* | *Prior art* |

DEVICE AND METHOD FOR REMOVING FLUIDS AND/OR SOLIDS

CROSS-REFERENCE TO RELATED APPLICATIONS

This application is a national stage application of International Application No. PCT/EP2009/058977, filed on Jul. 14, 2009, which claims the benefit of European Patent Application No. 08012666.7, filed on Jul. 14, 2008, the entire contents of both applications are incorporated herein by reference.

BACKGROUND OF THE INVENTION

1. Field of the Invention

Embodiments of the present invention relate to a device for removing at least fluids from a mixture of particulate materials, comprising a container having a circular process chamber with a cylindrical external contour, an input device for inputting a mixture of particulate materials into the process chamber, a discharge device for discharging the particulate materials at least partly freed at least of the fluids from the process chamber, a feed device for feeding a fluidizing agent from below into the process chamber and at least one conditioning device for conditioning, in particular heating, the fluidizing agent in the direction of flow prior to the feed device, wherein up to n walls and n cells extending in the vertical direction are provided in the process chamber, where $n \in N$, a first cell is in operative connection with the input device, an $n^{th}$ cell is in operative connection with the discharge device, the upper ends of the n cells are open, the first (n−1) cells are adapted to allow the fluidizing agent to flow therethrough from below through a base provided with first openings, and the walls between the n cells, from the first to the $n^{th}$ cell, each comprise at least one second opening for passage of particulate materials, as well as a method for removing at least fluids from a mixture of particulate materials in such a device.

2. Description of the Related Art

A device for removing fluids and/or solids is described, for example, in EP 07002861.8-1266, not pre-published, and will be explained in more detail below with reference to FIGS. 6 and 7.

FIG. 6 shows a drying device 1 having a container 2, comprising a substantially cylindrical outer skin 3. Therein, the container 2 is placed on a rack 4 to not only make the container 1 accessible for maintenance also from below, but also to facilitate an evacuation of dried particulate materials into a further processing plant. It can be seen in FIG. 6 that the external contour of the container 2 is substantially cylindrical. The geometrical structure of the container 2 and the components disposed therein is described below.

The container 2 set up on the rack 4 comprises at its lower end facing the rack 4, a vaulted base 5 in which there is disposed a not illustrated fan impeller by which a fluidizing agent in particular, overheated vapor, is circulated in the container 2. Within the container 2, there is disposed a substantially cylindrical super heater 6, so that the fluidizing agent is introduced from below into a substantially circular process chamber 20, which is designed between the super heater 6 and the outer skin 3 and into which materials to be treated can be input by way of a not illustrated input device. Therein, the process chamber 20 is delimited at its lower end by a distribution plate 7 held by means of a distribution plate holder which allows the passage of the fluidizing agent through a plurality of not shown openings from below, but does not permit the materials to be treated to fall through.

Above the distribution plate 7, there are disposed vertically aligned walls 8, which extend from the external wall of the super heater 6 to the container wall, i.e. the outer skin, and form n cells between them. The walls 8 can reach down to the distribution plate 7 or form a free space in between. The cells formed by the walls 8 are open at the top, so that the fluidizing agent flows through the cells from the bottom up and fluidizes the materials or particles to be treated, partly carrying them along upwards and transporting them into a downstream cell, if necessary. The fluidizing agent does not substantially flow through the $n^{th}$ cell or discharge cell provided with a not illustrated discharge device, so that any material entering such cell without a distribution plate from the top or along the distribution plate 7, reaches the base area and can be removed from the discharge cell by way of the discharge device, for example, a conveying screw.

Above the walls 8, there follow swirl blades 9 which can also be disposed, staggered, between the walls 8 in the circumferential direction and which correspond, in their vertical extension, approximately to the vertical extension of the walls 8 or extend beyond them, i.e. can be longer than the walls. The swirl blades 9, each one at its lower side facing the walls 8, are substantially aligned parallel to the walls 8, so that the pressure side of the swirl blades 9 is oriented at an angle of 0° to the axial component of the flow velocity of the fluidizing agent. The swirl blades 9 are designed curved in the embodiment illustrated in FIG. 6 and are oriented in such a way that the curve points from the input cell are in operative connection with the input device to the discharge cell, i.e. in the direction of flow of the particulate materials. If, for example, the input cell and the discharge cell are disposed next to each other interposing a wall 8, then the curve of the swirl blades 9 assigned to the input cell points away from the discharge cell, so that the particle and material stream has to be transported over the entire perimeter of the container 2 and thus of the process chamber 20 in order to reach the discharge cell.

At their upper end, the swirl blades 9 comprise a curve of up to 35° to the axial component of the flow velocity of the fluidizing agent to divert the stream of the fluidizing agent as well as that of the materials in the circumferential direction. The swirl blades 9 constitute an extension of the walls 8, wherein such extension can be designed with or without a gap between the swirl blades 9 and the walls 8. The swirl blades 9 can form a simple or double-curved area, i.e. comprise a curve around both the axial component and a radial component in order to divert the flow of the fluidizing agent and the direction of motion of the material or the solids according to the requirements. Instead of a curve, an inclination of otherwise straight-walled swirl blades 9 can also be provided for diverting the direction of flow.

Above the swirl blades 9, there is designed a transition area 10 embodied as a free space, which is provided without internals influencing the flow, so that the flow of the fluidizing agent as well as the transport of the same, together with the particles carried along in the fluidizing agent stream, can substantially take place unhindered. Such free space 10, the so-called transition area, is designed in an annular form and allows an uninterrupted, free, circular passage of both the materials and the fluidizing agent in the horizontal plane.

Above the swirl blades 9 and the transition area 10, there are disposed additional swirl blades 11, which also comprise a simple or double-curved area on their pressure side, with an entry angle of up to 15° in relation to the axial flow velocity component. In the same nomenclature, the exit angle is up to 90°, wherein the inside diameter of the blading corresponds to the outside diameter of the super heater 6.

The additional swirl blades 11 are a component of a dust separator 12, the outside diameter of which is smaller than the outside diameter of the process chamber 20 and thus smaller than the outside diameter of the container housing in the area of the walls 8 and the swirl blades 9. The outside diameter of the additional swirl blading corresponds to the outside diameter of the dust separator 12. By adapting the additional swirl blading to the swirl blades 9, the construction of the device 1 will be optimized with regard to the pressure loss, so that the overall device can be operated at a high level of efficiency. Therein, the external contour 3 of the container 2 is cylindrical at least up to the level of the swirl blades, in the present case up to the level of the dust separator 12 or the additional swirl blades 11, which avoids a material-intensive design of the container 2, preferably designed as a pressure container. The swirl blading generates and supports a pre-swirl or the swirl flow above a fluidized bed present in the chamber 20, which ensures that the required and desired further transport from the input cell to the discharge cell is not only supported for fine particles. Within the dust separator 12, there is generated a centrifugal field in which the dust particles and particulate materials carried along are moved around externally and are discharged through an opening.

Above the additional swirl blades 11, there are disposed return blades 13, oriented opposite the swirl direction, which redirect the swirl of the fluidizing agent, transforming it into a static pressure to feed the fluidizing agent into the super heater 6. The return or back-swirl blades 13 also comprise a simple or double-curved or inclined area with an entry angle of up to 90° in relation to the axial flow velocity component of the fluidizing agents, wherein the exit angle is up to 10° in the same nomenclature. The inside diameter of the blading corresponds to the outside diameter of an outlet pipe 14, while the outside diameter of the blading corresponds to the inside diameter of the super heater 6. By way of the upper opening 14*a* as shown in FIG. 6, vapor can escape from the container 2 and can be reused, preferably energetically, in another process.

FIG. 7 illustrates a horizontal section along the line D-D of FIG. 6. At the lower end of FIG. 7, there is shown the input cell 15, which is in operative connection with the not illustrated input device, for example, a conveying screw, and which is disposed directly next to the discharge cell 17, wherein the input cell 15 and the discharge cell 17 are fluidically separated from each other in such way that a direct transition of the material from the input cell 15 to the discharge cell 17 is prevented. Starting from the input cell 15, it follows a plurality of processing cells 16 that are separated from each other by the intermediate walls 8. Therein, the intermediate walls 8 can border directly on the container wall or can be suspended at a certain distance thereof within the annular process chamber 20 which is delimited by the distribution plate 7 at its lower side and by the lower side of the swirl blades 9 at its upper side. Within the processing cells 16, intermediate heating walls 18 can be disposed to provide additional thermal energy for the drying process.

Furthermore, EP 0 955 511 B1 describes an alternative device for drying granular material by means of overheated vapor in which an arrangement for automatically regulating a particle flow from cell to cell, preferably comprising a shutter for an opening of a wall between two adjacent cells, is provided between all processing cells, including an input cell and a discharge cell. However, the use of such shutters involves the risk that an accumulation of granular material occurs before each closed shutter, so that the respective shutter gets jammed and can thus no longer be opened purposefully, with the consequence that neither the degree of drying nor the discharge quantity of dried granular material can be adjusted reproducibly.

SUMMARY OF THE INVENTION

Therefore, an object of embodiments of the present invention is to further develop the device of the above-mentioned type in such way that it overcomes the disadvantages of the prior art.

This object is achieved according to the embodiments of the present invention by attaching at least one boundary wall for delimiting an intermediate space between the $(n-1)^{th}$ cell and the $n^{th}$ cell to the wall between the $(n-1)^{th}$ cell and the $n^{th}$ cell, wherein the intermediate space is connected to the $(n-1)^{th}$ cell by way of the second opening in the wall between the $(n-1)^{th}$ cell and the $n^{th}$ cell, which, in particular, is designed in the form of a recess at the side of said wall facing the base, the intermediate space can be connected to the $n^{th}$ cell by way of at least a third opening, which, in particular, is designed in the form of a recess in the boundary wall at the side of the boundary wall facing the base, the intermediate space can be closed by the boundary wall at the upper end thereof opposite the base and to the side, and fluidizing agent can flow from below through first openings in the base, and the third opening can be closed or opened at least temporarily, at least partly by at least one closing member of the discharge device.

Therein, it can be provided that the closing member can be moved, preferably controlled, in particular depending on output data of at least one sensor, by way of a driving device of the discharge device.

Therein, it is preferred that a fluidized bed of the particulate material can be generated by the fluidizing agent in the first (n−1) cells and the intermediate space, and the sensor measures at least one characteristic quantity of the fluidized bed, wherein preferably no fluidized bed is present in the $n^{th}$ cell.

Therein, it is proposed by the invention that a differential pressure of the fluidized bed can be measured by way of the sensor, preferably, by means of a first detector within the fluidized bed and a second detector outside, in particular, above the fluidized bed, in particular in the $(n-1)^{th}$ cell.

Furthermore, it can be provided that the driving device comprises at least one motor, such as a geared motor or a stepper motor, preferably with a positioner for positioning the closing member, and/or the closing member is connected to a motor of the driving device by way of a shaft.

Therein, it is proposed that the closing member comprises a circular segment cross-section disposed coaxially to the shaft.

Moreover, preferred embodiments according to the invention are characterized in that at least two closing members are provided, wherein preferably the closing members are disposed and evenly distributed on a concentric circle around the shaft.

It is also proposed by the embodiments of the present invention that each closing member can be moved from the bottom up along the third opening, preferably, on a circular arc.

Furthermore, it can be provided that each closing member is disposed in the $n^{th}$ cell and the associated driving device is disposed outside the container, so that the shaft between the driving device and the closing member passes through the external contour of the container.

It can also be provided that the boundary wall, in particular a roof part of the same, extends at the upper end of the intermediate space from the third opening to the second opening in the wall between the $(n-1)^{th}$ cell and the $n^{th}$ cell, preferably inclined and/or bent upwards.

Moreover, it is proposed that the discharge device comprises a conveying device, which runs at least partly in the $n^{th}$ cell.

It can also be provided that the discharge device comprises a variable-frequency inverter.

Furthermore, embodiments of the invention can be characterized in that at least a fourth opening is disposed above the second opening in the wall between the $(n-1)^{th}$ cell and the $n^{th}$ cell, so that particulate material can enter from the $(n-1)^{th}$ cell into the $n^{th}$ cell above the intermediate space.

Therein, it is proposed that the fourth opening can be at least partially and temporarily closed, preferably by a further closing member of the discharge device.

Furthermore, preferred embodiments of the present invention are characterized by a wall between the $n^{th}$ cell and the first cell, wherein such wall comprises no opening.

It can also be provided that the n cells are disposed concentrically around the conditioning device preferably comprising a super heater.

Moreover, it is proposed that swirl blades, which are inclined or curved in the direction of flow of the particulate materials from the first cell to the $n^{th}$ cell are disposed above the walls, wherein the outside diameter of the swirl blades is not greater than the outside diameter of the walls and the swirl blades are surrounded by an external cover, which does not project radially beyond the external cover which surrounds the walls.

Embodiments of the present invention also provide a method for removing at least fluids from a mixture of particulate materials in a device according to the embodiments of the present invention are characterized in that the residence time of the particulate material in the process chamber of the device is determined depending on a fluidized bed differential pressure in the process chamber.

Therein, it can be provided that, for discharging the particulate materials at least partly freed at least of fluids from the process chamber, each closing member closing the third opening is at first turned from its respective closing position into an opening position preferably completely releasing the third position, preferably gliding past the third opening from the bottom up, and the closing member is subsequently held in the opening position for a first certain duration.

Alternatively, it is proposed that, for discharging the particulate materials at least partly freed at least of fluids from the process chamber, each closing member is at first brought into a stationary state for a second certain duration, in which state the third opening is partly opened, and the third opening is further opened, in particular completely opened, at least once for a third certain duration during the second certain duration, wherein, preferably for opening the third opening at least in some areas, at least one closing member is moved past the third opening from the bottom up.

Moreover, it can be provided that, for at least partly closing the third opening, preferably, depending on the first or second and/or third duration, at least one closing member first closes the third opening either from the top down or from the bottom up.

Finally, it is also proposed according to the embodiments of the present invention that the process chamber is filled with a mixture of particulate materials and a fluidizing agent is fed into the process chamber in such way that the fluidized bed builds up at least in the $(n-1)^{th}$ cell, at least up to the fourth opening.

Thus, embodiments of the present invention are based on the surprising finding that, when operating the drying device with a continuous input of particulate materials to be dried and a continuous discharge of dried material, a fluidized bed differential pressure gradient is induced, which is sufficient as a driving force for transport of the particulate materials to be dried in the fluidized bed from processing cell to processing cell, on the one hand, and ensures a permanent particle movement before a closing member, on the other hand, which is only necessary between the last processing cell, which spreads the fluidized bed, and the discharge cell without a fluidized bed, if the closing member is not used for closing an opening of a wall between said last processing cell with a fluidized bed and the discharge cell without a fluidized bed, but for closing an opening of an intermediate space between said last processing cell and the discharge cell, so that no jamming of particles and/or no accumulation of a product difficult to fluidize will occur before the closing member.

Furthermore, based on the knowledge obtained from the embodiments of the present invention, when the quantity of particulate materials fed into the fluidized bed is increased, the fluidized bed differential pressure will increase so that, for guaranteeing stationary process conditions in the fluidized bed with an approximately constant filling and product residence time, an adjustment of the discharge of the particulate materials at least partly freed at least of fluids has to be made depending on said fluidized bed differential pressure. This enables a controlled quantity of particulate materials in the fluidized bed, with a simultaneous optimization of the removal of the fluids from the particulate material. Furthermore, it is ensured that the fluidized bed in the process chamber will not become depleted of fluidized material and is thus maintained even in case of a short-time interruption or reduction of the feeding of said mixture of particulate materials into the process chamber.

Further features and advantages of the embodiments of the present invention will be apparent from the following description in which exemplary embodiments of the invention are explained in more detail based on the accompanying drawings described below.

BRIEF DESCRIPTION OF THE DRAWINGS

FIGS. 5*a* to 5*c* show local sectional views of a processing cell and a discharge cell of the device of FIGS. 1 to 3, with different positions of the closing device of FIG. 4;

FIG. 6 is a perspective local sectional view of a known device; and

FIG. 7 is a sectional view taken along line D-D in FIG. 6.

DETAILED DESCRIPTION

Figure 1:
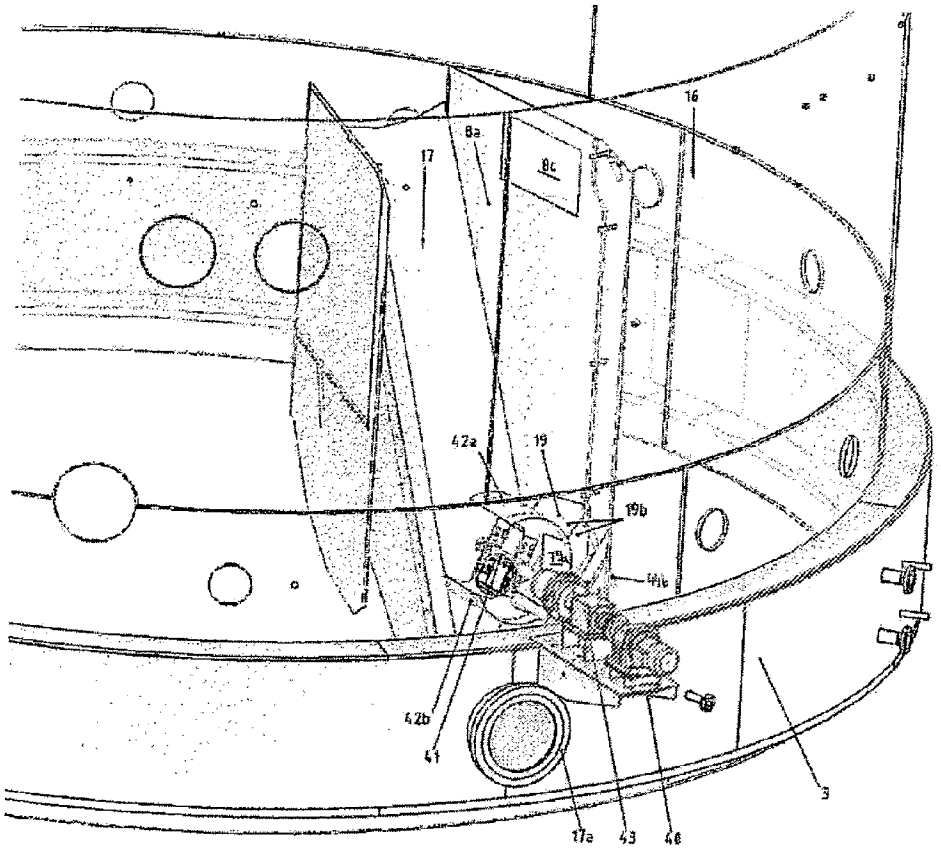
FIG. 1 shows a first perspective local sectional view of a device according to an embodiment of the present invention.

A drying device according to the embodiments of the present invention constitutes a further development of the device 1 as described with reference to FIGS. 6 and 7, wherein the same parts are denoted by the same reference numerals and are not described again herein. More precisely, the drying device 1 according to the embodiments of the present invention as shown in FIGS. 1 to 3 in different perspective local sectional views, substantially differs from the known drying device 1 of FIGS. 6 and 7 in that it has a closing device 40, which is illustrated in detail in FIG. 4.

Figure 4:
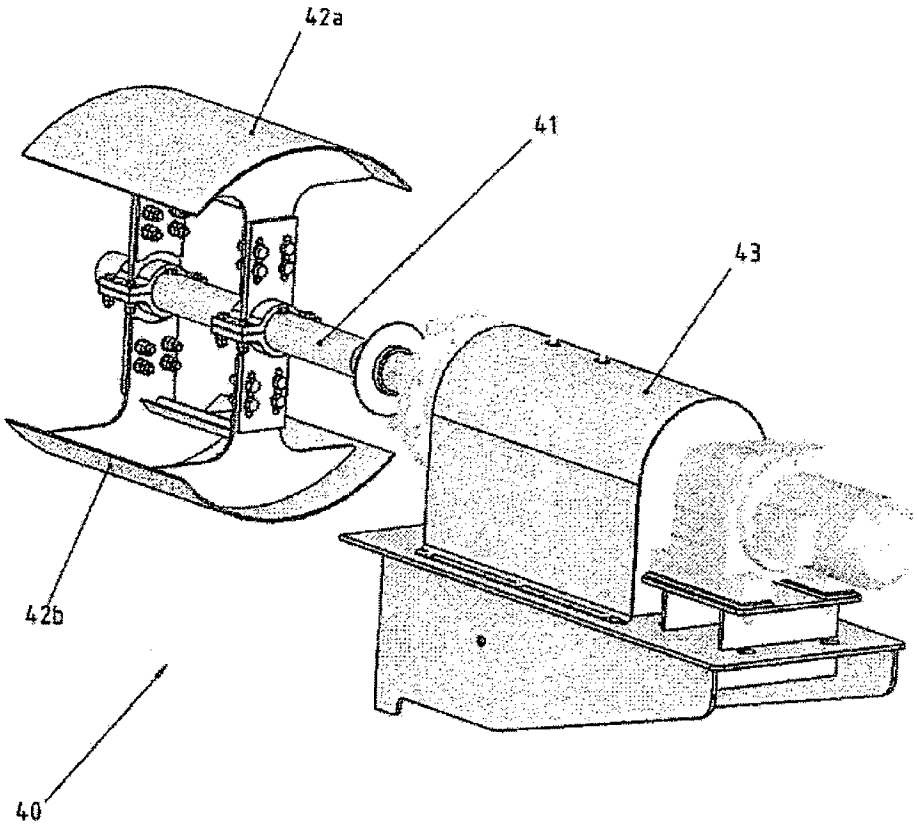
FIG. 4 shows a perspective view of a closing device of the device of FIGS. 1 to 3.

According to FIG. 4, the closing device 40 comprises a shaft 41 for connecting two closing members 42*a*, 42*b* to a driving device 43. The closing members 42*a*, 42*b* are disposed, in cross-section, on a circle, which is concentric to the shaft 41, and is evenly distributed along the circle, so that they face each other, so to speak.

As can be seen from FIG. 1, the driving device 43 of the closing device 40 is disposed outside the outer skin 3 of the drying device 1, while the closing members 42*a*, 42*b* are disposed rotatably in the discharge cell 17 by way of the shaft 41. In the area of the closing members 42*a*, 42*b*, the discharge cell 17, which does not include a distribution plate, is not disposed, so to speak, directly adjacent to the last processing cell 16, which includes a distribution plate (not shown) as illustrated in FIGS. 1 and 3 while FIGS. 5*a*-5*c* depict the position of the distribution plate. It is rather clearly visible in FIGS. 1 to 3 that an intermediate space, which is subsequently called loosening space 19 for reasons that will be explained in more detail below, is disposed between the processing cell 16 and the discharge cell 17. For this, a boundary wall 19*b* is disposed at the wall 8*a* between said processing cell 16 and the discharge cell 17 in the area of the opening 8*b*, which constitutes a recess of the wall 8*a* at the end facing the distribution plate, so that the loosening space 19 is connected to said processing cell 16 by way of the opening 8*b* and to the discharge cell 17 by way of a further opening 19*a*. As can best be seen in FIGS. 5*a*-5*c*, the loosening space 19 is delimited by the boundary wall 19*b* at its top and side, and is delimited at its bottom by the distribution plate 7.

Figure 2:
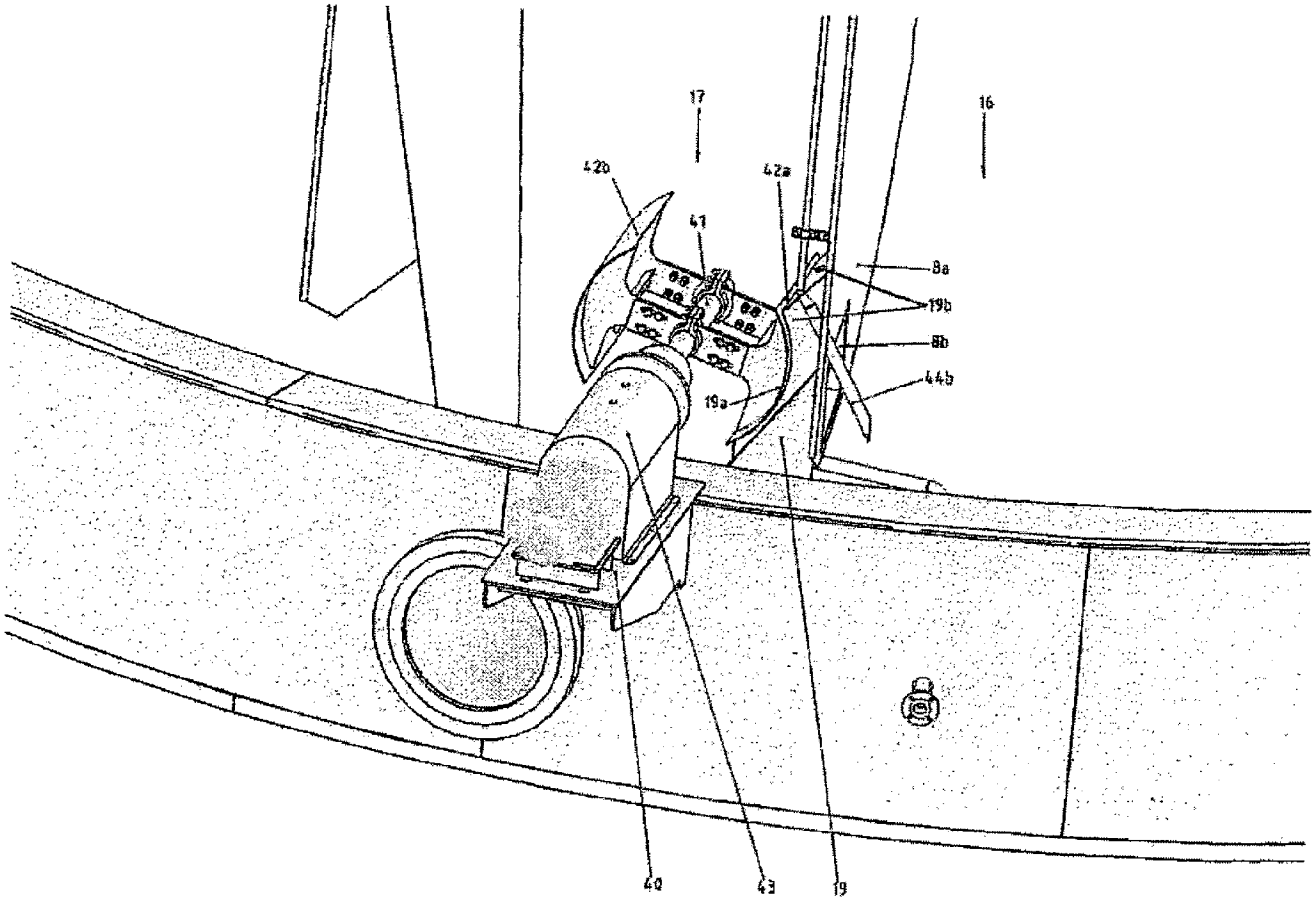
FIG. 2 shows a second perspective local sectional view of the device of FIG. 1.
Figure 3:
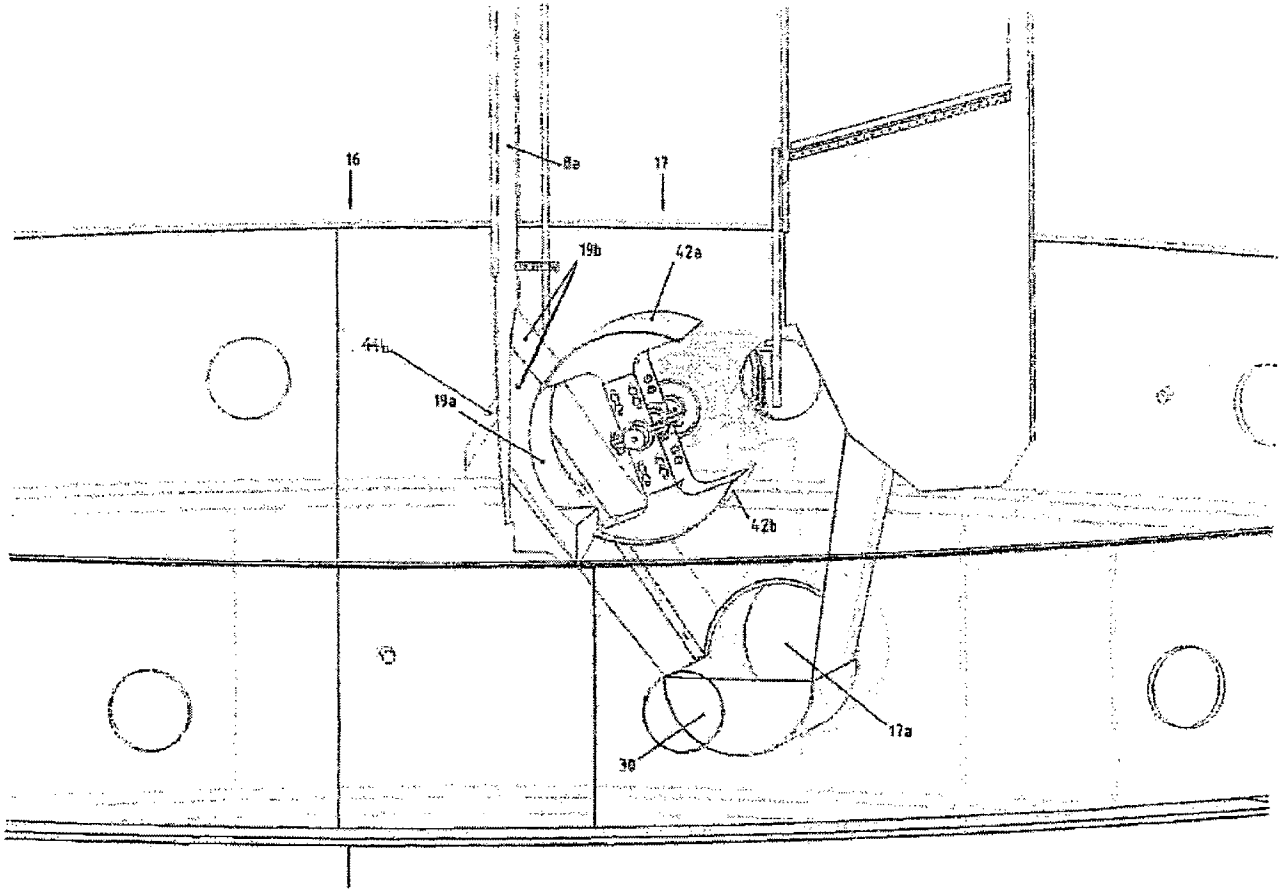
FIG. 3 shows a third perspective local sectional view of the device of FIGS. 1 and 2.

The opening 19*a* of the loosening space 19 can be closed by way of one of the closing members 42*a*, 42*b*, as illustrated, for example, in FIG. 2. However, if none of the closing members 42*a*, 42*b* are disposed in front of the opening 19*a*, as illustrated, for example, in FIG. 1 or 3, particulate materials from said processing cell 16 can enter into the discharge cell 17 by way of the loosening space 19, from which they can then be led out by way of a conveying device 30, namely in the area of an opening 17*a*, which is best illustrated in FIGS. 1 and 3.

The mode of operation of the drying device 1 is hereinafter explained with reference to FIGS. 5*a* to 5*c*.

If a mixture of particulate materials is constantly introduced into the process chamber 20, more precisely into the input cell 15 in the process chamber 20, and a fluidizing agent, for example, in the form of vapor heated up in the super heater 6 and blown by way of the fan impeller in the base 5 through openings in the distribution plate 7 from the bottom up, is simultaneously introduced into the process chamber 20, then a fluidized bed is built up in the process chamber 20 and with it, a fluidized bed differential pressure. Such fluidized bed differential pressure is proportional to the quantity of particulate materials in the fluidized bed. The driving force for the materials transport from the input cell 15 to the discharge cell 17 consists in a permanent fluidized bed differential pressure difference, which adjusts from the input towards the discharge in case of a continuous operation of the drying device 1. Therein, the materials transport goes from the input cell 15 via the processing cells 16 into the discharge cell 17, and through openings in the intermediate walls 8, such as, for example, the opening 8*b* in the intermediate wall 8*a* between the last processing cell 16 with a distribution plate 7 and the discharge cell 17 without a distribution plate 7. In order to guarantee stationary process conditions in the fluidized bed, with an approximately constant filling and product residence time, materials must be able to flow out according to the inflow of the materials from the fluidized bed, i.e., must be able to leave the drying device 1 through the opening 17*a*. This can occur in different ways.

Before the flowing out of materials is described in more detail, it should be mentioned that, in case of a closure of the opening 19*a* of the loosening space 19 by the closing member 42*a*, as shown in FIG. 5*a*, due to the inclination of the roof part of the boundary wall 19*b* from the opening 19*a* of the loosening space 19 to the opening 8*b* in the wall 8*a*, and upwards, it is ensured that a fluidizing agent entering through the distribution plate 7 into the loosening space 19 enters into the processing cell 16 with a distribution plate 7 along the arrow B and thus, a constant solids movement is guaranteed before the closing member 42*a* causes a closed state of the loosening space 19. Therefore, a loosening of the particulate materials really takes place in the loosening space 19, which avoids forming of particularly coarse product particles, e.g., by agglomeration, during a longer closing phase, which can then no longer be discharged from the process chamber 20, but would rather lead to an obstruction in the loosening space 19. In the following, three variants of discharging material from the process chamber 20 by way of the opening 17*a* are described:

First Variant

The closing member 42*a* is turned or rotated clockwise from the closing position as shown in FIG. 5*a* into the opening position as shown in FIG. 5*b*. This direction of rotation is important because it guarantees that the closing member 42*a* glides past the opening 19*a* from the bottom up, so that coarser particles will not lead to a jamming between the closing member 42*a*, on the one hand, and the wall 8*a* and/or the distribution plate 7, on the other hand.

The complete unobstruction of the opening 19*a* as shown in FIG. 5*b* will then cause coarser particles to be discharged from the loosening space 19 through an intense pulse exchange with the remaining fluidizing solid in the fluidized bed. Therein, the driving force for that transporting effect is provided by the fluidized bed differential pressure, which is also approximately present between the loosening space 19 and the discharge cell 17.

After a fixed opening time, the closing member 42*b* is then brought back in its closing position and will remain there for a fixed duration. Therein, the speed of the rotary movement must be so high that the fluidized bed before the discharge cell 17 will not be depleted of solids through too long an opening time of the loosening space 19. Therein, a speed of 10 to 20 revolutions per minute is desirable.

On the shaft 41, several closing members can be disposed to influence the opening times.

If the product stream from the processing cell 16 into the discharge cell 17 becomes too large, one of the closing members 42*a*, 42*b* can be turned into an only partly opened position, see FIG. 5*c*, for example, and remain in this position.

The duration of both the closed and the opened state of the loosening space 19 is to be controlled depending on a fluidized bed differential pressure. The latter is measured by way of two pressure sensors 44*a*, 44*b*, wherein the one pressure sensor 44*a* is disposed above the fluidized bed, and the other pressure sensor 44*b* is disposed within the fluidized bed in direct proximity above the distribution plate 7 of the processing cell 16, as can be seen in FIGS. 1-3.

The closing members 42*a* and 42*b* are selectively moved into their individual positions by way of the driving device 43, which can comprise a geared motor with a positioner.

For facilitating the discharge of the particulate material from the discharge cell 17, the conveying device 30 can be used.

Second Variant

The closing member 42*a* can be in a partly opened position, as shown in FIG. 5*c*, in which the lower edge of the closing member 42*a* is above the lower edge of the opening 19*a* of the loosening space 19. Through the opening of the loosening space 19 thus given, particulate materials from the processing cell 16 can enter into the discharge cell 17 after passing the loosening space 19, wherein the quantity thereof can be controlled depending on a measured fluidized bed differential pressure by changing the position of the closing member 42*a*.

For avoiding obstructions of the loosening space 19 by coarse particles, the closing member 42*a* can completely unobstruct the opening 19*a* in a preset rhythm for a short duration, as shown in FIG. 5*b*, namely, to enable the discharge of coarse particles that may be present. So, in case of a complete opening or unobstruction of the opening 19*a*, a kind of "cleaning" of the loosening space 19 and thus also in the fluidized bed present before the closing member 42*a* in its partial closing position takes place.

If, in the rotary movement of the closing member 42*a* for closing the opening 19*a*, a torque which exceeds a preset maximum value during a clockwise rotation should occur, the rotation can also take place anticlockwise. Moreover, this measure serves to remove any particles that may be jammed between the closing member 42*a* and the borders of the opening 19*a* of the loosening space 19.

The necessary rotary movement of the closing members 42*a*, 42*b* also depends on the number of the closing members.

Third Variant

Through a further opening 8*c* in the wall 8*a* between the processing cell 16 and the discharge cell 17, which is visible in FIG. 1, it is possible to allow particulate materials to flow directly from the processing cell 16 into the discharge cell 17, namely above the loosening space 19. For this purpose, the fluidized bed within the processing cell 16 has to reach at least up to the lower edge of the opening 8*c*.

If the opening 8*c* is disposed in the area of the nominal fluidized bed level, it functions as a stationary weir that allows particulate materials to enter from the processing cell 16 into the discharge cell 17.

If one combines a particle transport by way of the opening 8*c* with a transport through the loosening space 19, either according to the first variant or according to the second variant, then substantially coarse particulate materials will flow through the loosening space 19, which helps to improve a controlled fluidization.

The features disclosed in the above description, in the drawings, and in the claims can be essential to the realization of the invention in its different embodiments, both individually and in any combination.

LIST OF REFERENCE NUMERALS

1 Drying device
2 Container
3 Outer skin
4 Rack
5 Base with fan impeller
6 Super heater
7 Distribution plate
8 Wall
8*a* Wall
8*b* Opening
8*c* Opening
9 Swirl blade
10 Transition area
11 Additional swirl blade
12 Dust separator
13 Return blade
14 Outlet pipe
14*a* Opening
15 Input cell
16 Processing cell
17 Discharge cell
17*a* Opening
18 Intermediate heating wall
19 Loosening space
19*a* Opening
19*b* Boundary wall
20 Process chamber
30 Conveying device
40 Closing device
41 Shaft
42*a*, 42*b* Closing member
43 Driving device
44*a*, 44*b* Pressure sensor
A, B, B', C, C' Direction of flow
d Direction of rotation

The invention claimed is:

1. A device for removing at least fluids from a mixture of particulate materials, comprising:

a container having a circular process chamber with a cylindrical external contour;

an input device for inputting a mixture of particulate materials into the process chamber;

a discharge device for discharging the particulate materials at least partly freed at least of the fluids from the process chamber;

a feed device for feeding a fluidizing agent from below into the process chamber; and at least one conditioning device for conditioning the fluidizing agent in the direction of flow prior to the feed device, wherein up to n walls and n cells extending in a vertical direction are provided in the process chamber, wherein a first cell is in operative connection with the input device, an $n^{th}$ cell is in operative connection with the discharge device, the upper ends of the n cells are open, the first (n−1) cells are adapted to allow the fluidizing agent to flow therethrough from below through a base provided with first openings, and the walls between the n cells, from the first to the $n^{th}$ cell, each comprise at least one second opening for passage of particulate materials, wherein at least one boundary wall for delimiting an intermediate space between the $(n-1)^{th}$ cell and the $n^{th}$ cell is attached to the wall between the $(n-1)^{th}$ cell and the $n^{th}$ cell, wherein the intermediate space is connected to the $(n-1)^{th}$ cell by way of the second opening in the wall between the $(n-1)^{th}$ cell and the $n^{th}$ cell, wherein the intermediate space is capable of being connected to the $n^{th}$ cell by way of a third opening, wherein the intermediate space is capable of being closed by the boundary wall at an upper end thereof opposite the base and to the side, wherein fluidizing agent is capable of flowing from below through first openings in the base, and wherein the third opening is capable of being closed or partially opened at least temporarily by at least one closing member of the discharge device.

2. A device according to claim 1, wherein the closing member is controlled and moved by a driving device of the discharge device in response to output data of at least one sensor.

3. A device according to claim 2, wherein a fluidized bed of the particulate material is capable of being generated by the fluidizing agent in the first (n−1) cells and the intermediate space, and wherein the sensor measures at least one characteristic quantity of the fluidized bed, and wherein no fluidized bed is present in the $n^{th}$ cell.

4. A device according to claim 3, wherein a differential pressure of the fluidized bed is capable of being measured by the sensor using a first detector within the fluidized bed and a second detector outside and above the fluidized bed in the $(n-1)^{th}$ cell.

5. A device according to claim 2, wherein the driving device comprises at least one motor with a positioner for positioning the closing member, and wherein the closing member is connected to a motor of the driving device by way of a shaft.

6. A device according to claim 5, wherein the closing member comprises a circular segment cross-section disposed coaxially to the shaft.

7. A device according to claim 5, wherein at least two closing members are provided, and wherein the closing members are evenly distributed on a concentric circle around the shaft.

8. A device according to claim 5, wherein each closing member is disposed in the $n^{th}$ cell and the associated driving device is disposed outside the container so that the shaft between the driving device and the closing member passes through the external contour of the container.

9. A device according to claim 1, wherein each closing member is capable of being moved along a circular arc from a bottom to a top of the third opening.

10. A device according to claim 1, wherein a top part of the boundary wall is inclined and extends at an upper end of the intermediate space from the third opening to the second opening in the wall between the $(n-1)^{th}$ cell and the $n^{th}$ cell.

11. A device according to claim 1, wherein the discharge device comprises a conveying device that runs at least partly in the $n^{th}$ cell.

12. A device according to claim 1, wherein the discharge device comprises a variable-frequency inverter.

13. A device according to claim 1, wherein a fourth opening is disposed above the second opening in the wall between the $(n-1)^{th}$ cell and the $n^{th}$ cell, so that particulate material is capable of entering from the $(n-1)^{th}$ cell into the $n^{th}$ cell above the intermediate space.

14. A device according to claim 13, wherein the fourth opening is capable of being partially and temporarily closed by a closing member of the discharge device.

15. A device according to claim 1, wherein a wall between the $n^{th}$ cell and the first cell does not include any openings.

16. A device according to claim 1, wherein the n cells are disposed concentrically around the conditioning device.

17. A device according to claim 1, wherein the conditioning device is a super heater.

18. A device according to claim 1, wherein swirl blades that are inclined or curved in the direction of flow of the particulate materials from the first cell to the $n^{th}$ cell are disposed above the walls, wherein an outside diameter of the swirl blades is not greater than an outside diameter of the walls, and wherein the swirl blades are surrounded by an external cover that does not project radially beyond the external cover that surrounds the walls.

19. A device according to claim 1, wherein the second opening is a recess at a side of the wall facing the base, and wherein the third opening is a recess in the boundary wall at a side of the boundary wall facing the base.

* * * * *